United States Patent [19]

Scheffel

[11] 4,357,963

[45] Nov. 9, 1982

[54] LOOM WITH WEFT PICKING BY A FLOWING MEDIUM

[76] Inventor: Walter Scheffel, Hopfenstr. 22, 8832 Weissenburg/Bayern, Fed. Rep. of Germany

[21] Appl. No.: 150,359

[22] Filed: May 16, 1980

[51] Int. Cl.[3] ..... D03D 47/28

[52] U.S. Cl. ..... 139/435

[58] Field of Search ..... 139/435, 188, 190, 191; 226/97

[56] References Cited

U.S. PATENT DOCUMENTS 4,183,382 1/1980 Scheffel ..... 139/435

FOREIGN PATENT DOCUMENTS 1932836 1/1970 Fed. Rep. of Germany ..... 139/435
2056992 5/1972 Fed. Rep. of Germany ..... 139/435
2160998 6/1973 Fed. Rep. of Germany ..... 139/435
2420368 1/1975 Fed. Rep. of Germany ..... 139/435
2454878 5/1976 Fed. Rep. of Germany ..... 139/435
2631593 2/1977 Fed. Rep. of Germany ..... 139/435
2806301 8/1979 Fed. Rep. of Germany ..... 139/435
438167 11/1967 Switzerland .
586298 3/1977 Switzerland ..... 139/435

*Primary Examiner*—Henry Jaudon
*Attorney, Agent, or Firm*—Karl F. Ross

[57] ABSTRACT

In the loom, a thread guide channel is formed by upper plates and lower plates located in different cross-sectional planes of the channel. The lower plates are fixed to a sley, while the upper plates have their own guidance system formed in such a way that in each movement phase, points of the upper plates located furthest from the sley pivot point describe predetermined path lines which intersect the path lines of points on the lower plates furthest from the sley pivot point, so that during weft fastening the path line of upper the plates are at a smaller distance from the sley pivot point than in the weft insertion position of the sley. The upper plates are mounted on a pivot point on the sley and are pivotally connected by means of a connecting rod to another pivot point mounted extraneously of the sley.

Despite the smaller sley travel, an adequate spacing of the plates of the thread guide channel from the weft fastening during insertion into the shed is achieved.

3 Claims, 9 Drawing Figures

Fig. 4
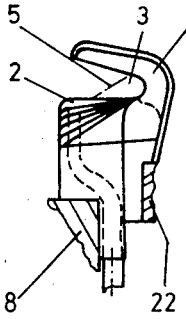
Fig. 5
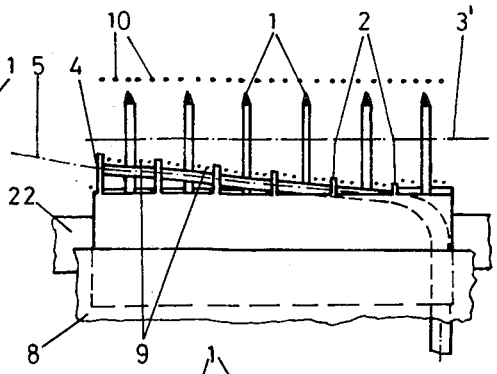
Fig. 6
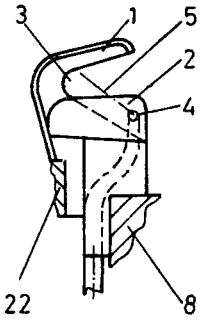
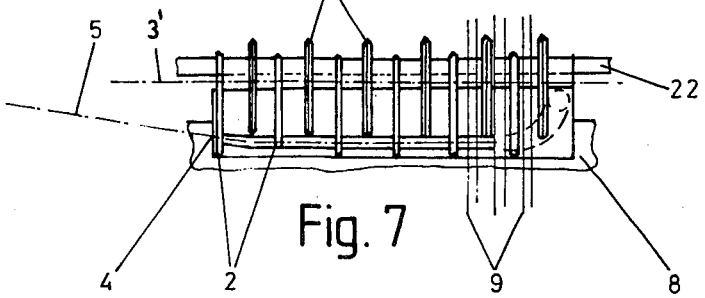
Fig. 7
Fig. 8
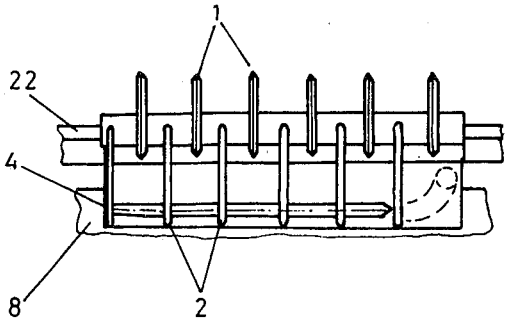
Fig. 9
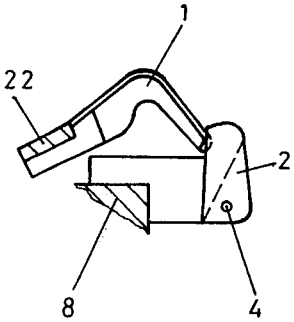

LOOM WITH WEFT PICKING BY A FLOWING MEDIUM

FIELD OF THE INVENTION

The present invention relates to a loom with weft picking by a flowing medium in which a guide channel formed from plates is fixed to the sley which passes into and out of the shed formed by the warp threads with the movement of the sley.

BACKGROUND OF THE INVENTION

In order to obtain a streak-free fabric, these thread guidance channels formed from plates must pass in and out of the shed at an adequate distance from the last fastened weft thread. However, in known looms this distance leads to large sley strokes, and therefore considerable shed heights. This in turn leads to limits being placed on performance, due to high inertia forces with wear, noise and high energy requirements.

Attempts have thereforebeen made to provide looms which, despite a limited sley travel, permit an adequate spacing of the weft thread guide channel plates during insertion.

Known devices of this type according to W. German published applications Nos. 2,631,593 and 2,454,878 attempt to solve this problem by a separate movement of the onepiece thread guide channel and the sley. The separate movement of the complete channel involves large strokes, so that new disadvantages occur.

Other known devices according to W. German published applications Nos. 1,932,836, 2,160,998, 2,056,992, 2,806,301, Swiss Pat. No. 586,298 or Swiss Pat. No. 438,167, operate with a movement of parts of the thread guide channel superimposed on the sley movement but do not have the features permitting a reduction of the sley travel. Their function is exclusively the opening and closing of the thread guide channel.

Another known device according to W. German published applications No. 2,420,368, with a movement of the entire thread guide channel superimposed on the sley movement, also had disadvantages from the performance and fabric quality standpoints. The thread guide channel used is dependent on the reed density and therefore on the fabric quality to be produced. As a result, in the case of changes, it is necessary to change the reed with the appropriate thread guide channel, which is extremely uneconomic. In addition, the thread guide plates for the weft threads to be moved through the shed leads to a restricted opening with increased thread friction, leading to additional material stressing and weft thread breaks with weaving errors.

Object of the present Invention

The object of the present invention is to provide a loom of the aforementioned type which completely fulfils the aforementioned requirements, while avoiding the disadvantages of the known apparatuses.

Summary of the Invention

According to the invention, this object is achieved in that the weft thread guide channel is formed by upper and lower plates which are located in different cross-sectional planes of the channel, the lower plates being fixed to a sley, while the upper plates have their own guidance systems constructed in such a way that in each movement phase, a point on the upper plate furthest from the sley pivot point gives a predetermined path line which intersects the path line of a point on the lower plates furthest from the sley pivot point and at a constant distance therefrom, so that in the position of weft beat up, the path line of the upper plates is at a smaller distance from the sley pivot point than in the sley insertion position.

The construction can advantageously be such that the upper plates are mounted on a pivot point on the sley and are also connected by means of a connecting rod to a pivot point not on the sley.

Due to the fact that there is now a separate movement of part of the guide plates forming the channel, small plate strokes are possible, accompanied by a reduced plate weight. There is also no need for a mechanical enclosing of the channel. This channel which, according to the invention, is in two parts in the plane of the channel axis and is open towards the reed side, is dynamically closed in the case of monostable thread guidance by the discharge position of the flow discharge openings distributed over the cloth width in a plurality of channel lengths in accordance with the latest state of the art. The flow discharge openings are for this purpose arranged close to the channel opening on the reed side and are directed in such a way that in the closed thread guide channel position and with an inoperative sley they ensure optimum conditions for a reliable and energy-saving picking which is free from secondary flows.

By shortening the sley stroke and reducing the shed height, it is possible to considerably increase the speed and therefore the weaving capacity of a loom constructed according to the invention without increasing the energy demand and the susceptibility to wear. Despite the increasing speed, the material of the warp material is less stressed by the shorter stroke and friction path of the reed and the heald shafts. There is also a reduction in the noise level due to the higher frequency and lower inertia forces.

BRIEF DESCRIPTION OF THE DRAWINGS

The above and other objects, features and advantages of the invention will become more readily apparent from the following description, reference being made to the accompanying drawing, in which:

FIG. 4 is a side view of the two-part thread guide channel of FIG. 1, shown in the closed position from the weft insertion side;

FIG. 5 is a rear view of the closed thread guide channel of FIG. 4, taken from the reed side;

FIG. 6 is a side view of the two-part channel in the closed position of FIGS. 4 and 5, taken from the weft discharge side and showing the flow discharge opening;

FIG. 7 is a plan view of the thread guide of FIG. 5;

FIG. 8 is a plan view of the thread guide of FIG. 7, shown in the open position according to FIG. 2;

FIG. 9 is a side view of the thread guide according to FIGS. 8 and 2, taken from the weft discharge side and showing the flow discharge opening.

Specific Description

Figure 1:
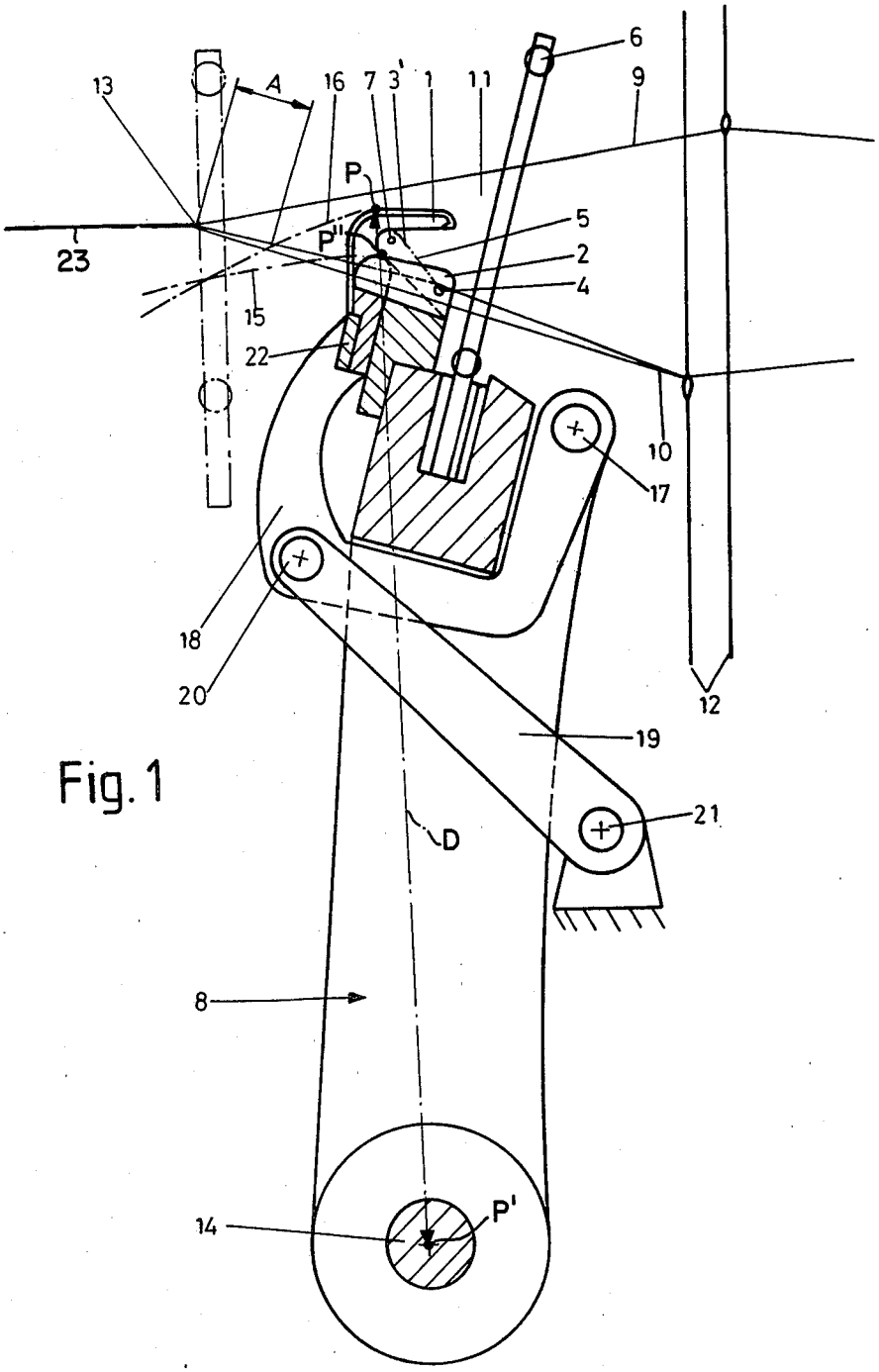
FIG. 1 is a side view of the device according to the invention on a loom in the weft picking position.
Figure 2:
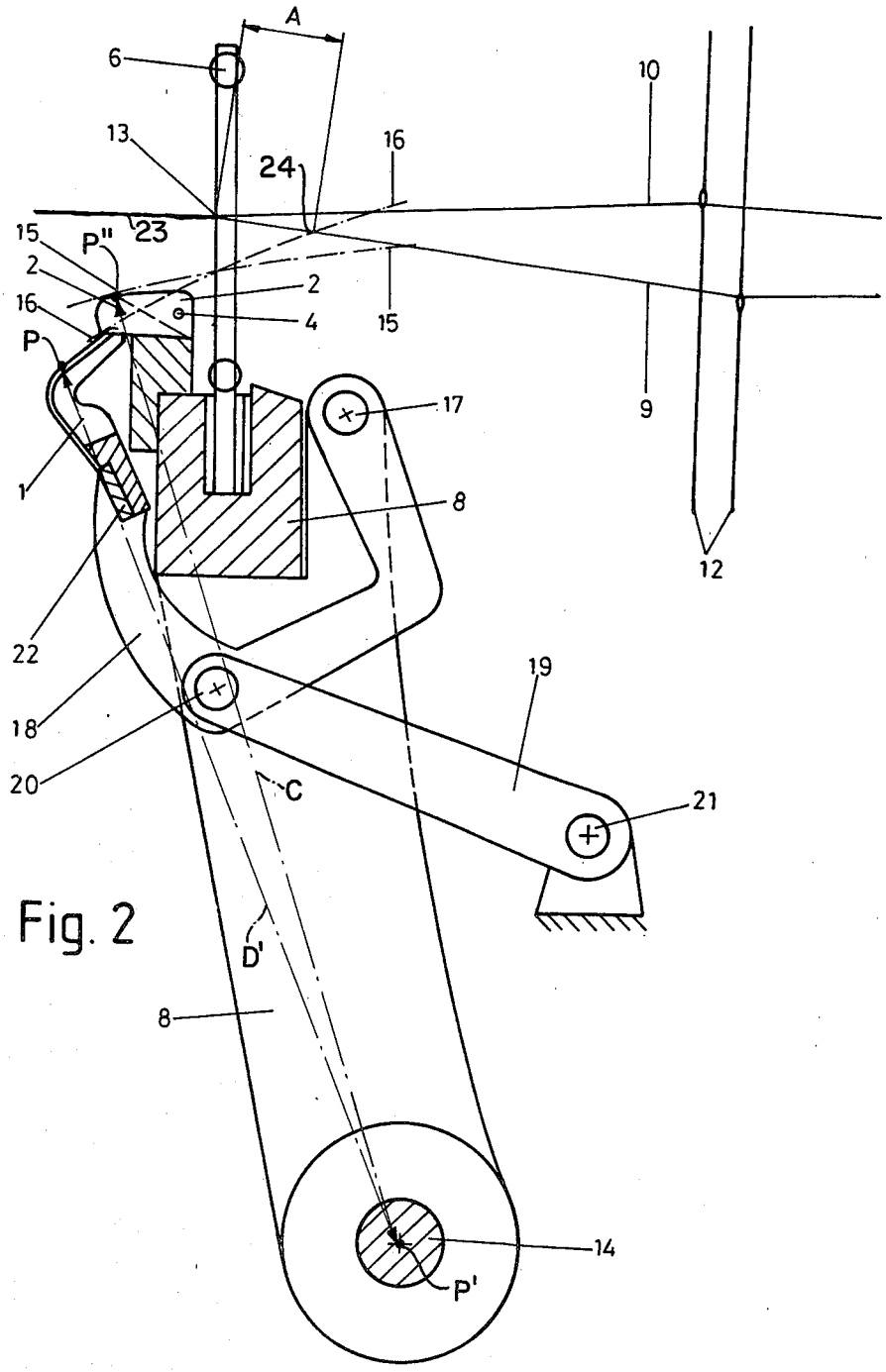
FIG. 2 is a side view of the device of FIG. 1, in the weft fastening position.
Figure 3:
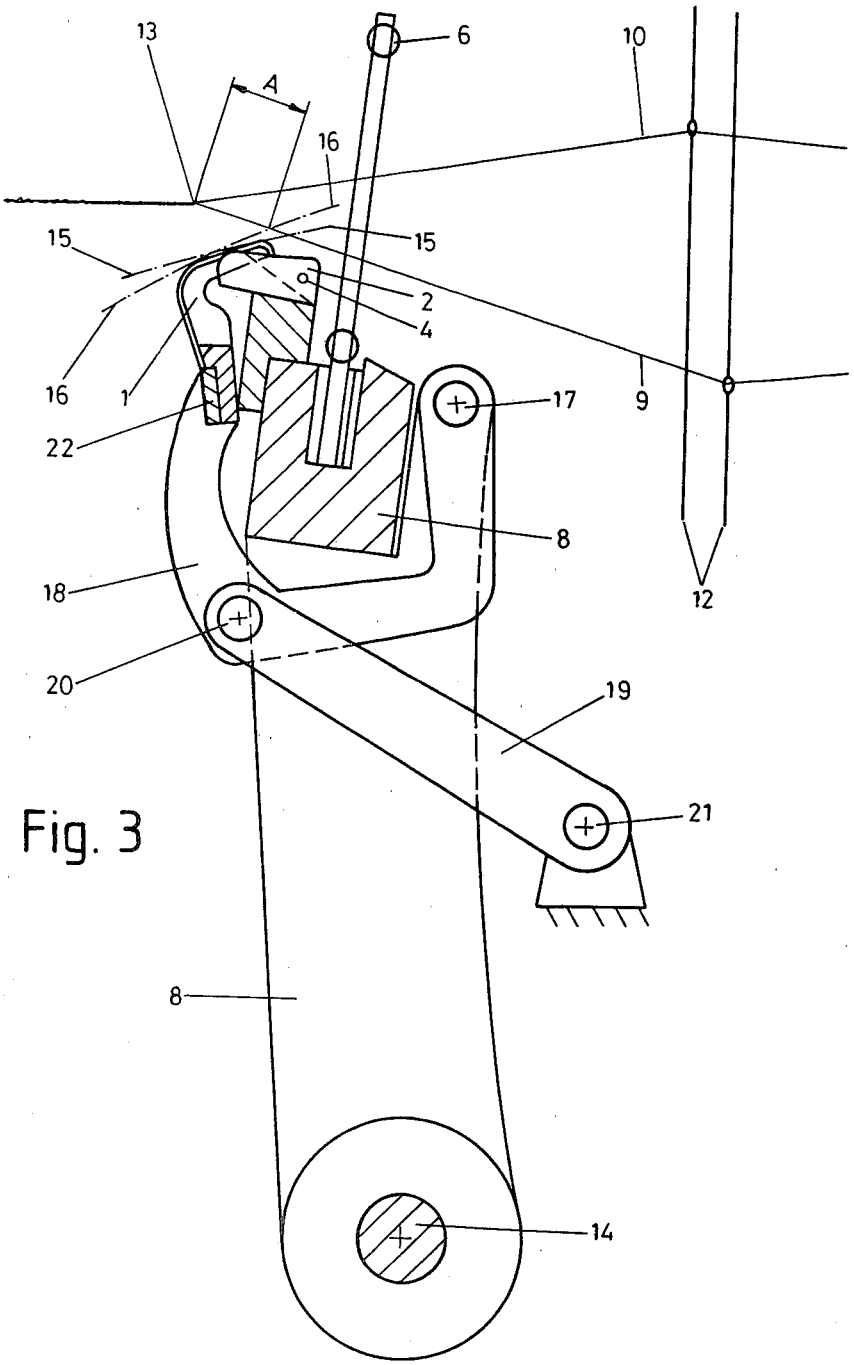
FIG. 3 is a side view of the device of FIGS. 1 and 2, showing the movement into the shed.

FIGS. 1, 2 and 3 show an apparatus according to the invention on a loom with a sley 8 which is pivoted at 14, a reed 6, heald shafts 12, warp threads 9 and 10, shed 11, fell 13, fabric 23 and the two-part thread guide channel 3, formed by interdigitated upper plates 1 and lower plates 2.

FIG. 1 is a side view of the apparatus in a weft thread insertion position, showing the weft 7 and the flow discharge opening 4 with the central axis 5 of the discharge flow. This axis lies close to the wide channel opening on the reed side and is directed in such a way that in the downstream direction, the axis 5 is diverted away from the plane of reed 6 and towards the channel axis 3'. The axis 5 of the discharge flow does not intersect the surface defined by channel 3 on the side where the flow discharge opening 4 are located.

As a result of the arrangement according to the invention, on the reed side the open channel 3 is dynamically enclosed and a monostable, energy-saving thread guidance is obtained.

FIG. 2 shows the apparatus in the weft beat up position. During movement from picking position to beat up position the paths 15 and 16 have been created. Path 15 is the result of the movement of point P''. Point P'' is the point on lower plate 2, which is further from sley pivot point P'.

Path 16 has been created by point P, which is on the upper plate. The fact that path 16 intersects path 15 proves that during movement of the sley, the point P has reduced its distance from the sley pivot point P'. At picking position its distance was D and at beat up position its distance is D'.

Point 24 is the intersection between path 16 and lower warp threads 9. The spacing between fell 13 and point 24 is A. Due to this adequate spacing A, a streak-free fabric with limited thread friction is ensured in spite of the short sley travel.

By means of the associated guidance system, path line 16 is produced by the upper plates 1 by the latter being mounted by means of a cross-member 22 to lever 18 pivotally mounted on the sley 8 at 17 for movement therewith, which is modified by means of the connecting rod 19, pivoted to lever 18 at the pivot point 20 and to the pivot point 21, mounted extraneously of the sley 8.

FIG. 3 shows the apparatus according to the invention on the loom just before entering between the warp threads into shed 11.

FIGS. 4, 5, 6 and 7 show a two-part thread guide channel 3 in the closed position from four sides. It comprises the upper plates 1 and the lower plates 2, the upper part of channel 3 being formed from plates 1 and the lower part of channel 3 from plates 2. The channel 3 formed by the two plate types 1 and 2 have different channel cross-sections, forming a tapering channel which widens in the upstream direction and is wide open on the reed side.

The thread guide channel 3 comprises channels of a specific length, so that several are required to span the width of fabric 23, so that there are plates with flow discharge openings 4, as well as plates without such openings. Starting with a plate having a flow discharge opening 4, the cross-section of a channel 3 increases in step-like manner in the upstream direction towards another plate with a flow discharge opening 4 according to FIGS. 1, 5 and 6.

FIGS. 8 and 9 show the arrangement of a two-part thread guide channel 3 according to the invention in plan view and side view, but in the open position according to FIG. 2 during weft fastening.

A further advantage of the present invention on a loom is the fixed connection between the flow discharge openings 4 and their supply means, together with the lower plates 2 on sley 8, providing an accurate and stable alignment of the discharge flow axis 5.

I claim:

1. A loom with weft thread picking by a flowing medium comprising:

a sley mounted on said loom and pivotable about a sley axis;

a reed mounted on said sley;

a plurality of first guide plates fixedly mounted on said sley adjacent said reed;

a plurality of second guide plates movably mounted on said sley, interdigitating with said first guide plates and movable relative thereto during movement of said sley, said first and second guide plates forming lower and upper limits of a guide channel having a central axis of said weft thread when said sley is in a weft insertion position;

flow discharge openings formed in a plurality of said first plates for directing said flowing medium toward said central axis in a downstream direction relative to the insertion of said weft thread for entraining same when said sley is in said weft insertion position; and a lever linkage on said sley coupled with said second guide plates for swinging same relative to said sley along an arcuate path intersecting the path of said first guide plates during pivotable displacement of said sley about said sley axis into said position.

2. The loom defined in claim 1, wherein:

said second guide plates are movably mounted on said sley by at least one first arm extending from said second guide plates and pivoted on said sley; and a second arm pivoted at one end to said first arm between the pivot thereof and said second guide plates, said second arm being pivoted at the other end to a point fixed extraneously of said sley.

3. The loom defined in claim 2, wherein said guide channel is open on the side facing said reed and each of said first guide plates is progressively shorter than the preceding first guide plate in the upstream direction to form a tapered guide channel which widens in the upstream direction towards the weft thread insertion point.

* * * * *